United States Patent [19]

Tokorozawa

[11] 4,446,993

[45] * May 8, 1984

[54] APPARATUS FOR DISPENSING A PRESELECTED AMOUNT OF LIQUID

[75] Inventor: Sadao Tokorozawa, Kanagawa, Japan

[73] Assignee: Pilot Man-Nen-Hitsu Kabushiki Kaisha, Tokyo, Japan

[ * ] Notice: The portion of the term of this patent subsequent to Nov. 8, 2000 has been disclaimed.

[21] Appl. No.: 351,682

[22] Filed: Feb. 24, 1982

Related U.S. Application Data

[63] Continuation of Ser. No. 926,057, Jul. 19, 1978, Pat. No. 4,413,751.

[30] Foreign Application Priority Data

Jul. 19, 1977 [JP] Japan ..... 52-86191

[51] Int. Cl.[3] ..... B65D 37/00

[52] U.S. Cl. ..... 222/214; 222/420

[58] Field of Search ..... 222/209, 213, 214, 420, 222/309; 128/214 F; 417/477

[56] References Cited

U.S. PATENT DOCUMENTS

| | | | |
|---|---|---|---|
| 2,393,838 | 1/1946 | Tarbox | 222/209 |
| 3,327,898 | 6/1967 | Farr | 222/214 |
| 3,737,251 | 6/1973 | Berman et al. | 417/477 |
| 3,826,137 | 7/1974 | Clarke | 222/420 |
| 3,877,609 | 4/1975 | Cullis | 222/214 |
| 3,990,444 | 11/1976 | Vail | 417/477 |

*Primary Examiner*—H. Grant Skaggs

*Attorney, Agent, or Firm*—Sughrue, Mion, Zinn, Macpeak and Seas

[57] ABSTRACT

Apparatus for very accurately dispensing a preselected amount of liquid in a drop-by-drop fashion. The liquid is peristaltically pumped intermittently from a reservoir to a discharge pipe by the successive squeezing and releasing of an elastic tube carrying the liquid and connected to the discharge pipe. The discharge pipe has a discharge port with a face, the face being perpendicular to the longitudinal axis of the discharge pipe. The outer diameter of the discharge pipe at the discharge port is less than or equal to twice the inner diameter of the discharge pipe at the discharge port. The preselected amount of the liquid that is dispensed in a drop-by-drop fashion from the discharge port satisfies the following conditions:

(1) $V=Q\times M\times C$
(2) $50\ mg \geqq Q$
(3) $0.5\ seconds \leqq M$
(4) $3/seconds \geqq C$
(5) $1.5 \leqq M\times C$ wherein:

V is the weight of the produced liquid drop,
Q is the feed quantity of said liquid,
M is the time interval between successive drops, and
C is the cycle of the pump.

12 Claims, 10 Drawing Figures

APPARATUS FOR DISPENSING A PRESELECTED AMOUNT OF LIQUID

This is a continuation of application Ser. No. 926,057, filed July 19, 1978, and now U.S. Pat. No. 4,413,751.

BACKGROUND OF THE INVENTION

1. Field of the Invention

The present invention relates generally to methods and apparatus for dispensing liquids and, more particularly, to a method and apparatus for very accurately dispensing a preselected amount of liquid in a drop-by-drop fashion.

2. Description of the Prior Art

It is conventional to employ a metering means, such as a pipette, burette, etc., to transfer small preselected amounts of liquid from a supply container to each of a plurality smaller containers. These types of liquid transfering methods are normally carried out manually to attained the needed accuracy because of the visual measurements required.

However, as the number of preselected amounts increases, it becomes increasing difficult to achieve the desired accuracy because the incidence of human error in measuring increases as the number of measurements per unit time increases. Efforts have been directed at automating the transfer operation, but such efforts have not yielded the desired results of increased accuracy, increased throughout, and lower measurement cost. If the transfer operation could be automated in a satisfactory fashion, it would have applications, for example, in blending and supplying of raw materials, and in blending of catalysts, color formers, sensitizers, etc. SUMMARY OF THE INVENTION The method and apparatus of the present invention permits a preselected amount of liquid to be very accurately dispensed in a drop-by-drop fashion. The liquid is peristaltically pumped intermittently from a reservoir to a discharge pipe by the successive squeezing and releasing of an elastic tube carrying the liquid and connected to the discharge pipe. The discharge pipe has a discharge port with a face, the face being perpendicular to the longitudinal axis of the discharge pipe. The outer diameter of the discharge pipe at the discharge port is less than or equal to twice the inner diameter of the discharge pipe at the discharge port. The preselected amount of the liquid that is dispensed in a drop-by-drop fashion from the discharge port satisfies the following conditions:

(1) $V=Q\times M\times C$ (2) $50\text{ mg} \geqq Q$ (3) $0.5\text{ seconds} \leqq M$ (4) $3/\text{seconds} \geqq C$ (5) $1.5 \leqq M\times C$ wherein:

V is the weight of the produced liquid drop,

Q is the feed quantity of said liquid,

M is the time interval between successive drops, and

C is the cycle of the pump.

DETAILED DESCRIPTION OF THE INVENTION

Figure 1:
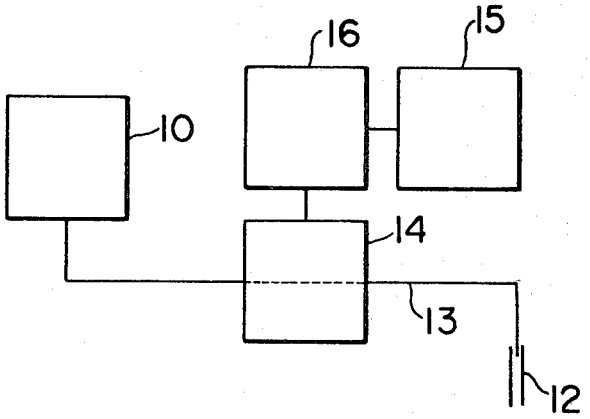
FIG. 1 is a block diagram of an embodiment of the method and apparatus of the present invention.
Figure 2:
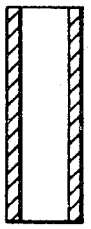
FIG. 2 is a cross-sectional side view of one embodiment of the discharge port of the discharge pipe.
Figure 3:
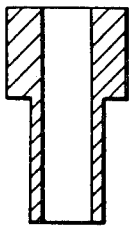
FIGS. 3–6 are a cross-sectional side views of other embodiments of the discharge port of the discharge pipe.
Figure 4:
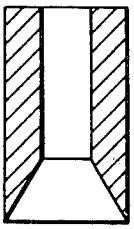
Figure 5:
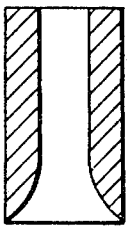
Figure 6:
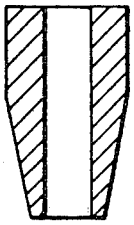

Referring now to FIG. 1, a block diagram of the method and apparatus of the present invention is shown. An elastic tube, designated generally by the reference numeral 13, is provided between a fluid source or reservoir, designated generally by the reference numeral 10, and a discharge pipe having a discharge port, designated generally by the reference numeral 12. Thus, elastic tube 13 provides a liquid flow path between reservoir 10 and discharge port 12.

A peristaltic pump, designated generally by the reference numeral 14, is arranged to provide intermittent pumping of the liquid from the reservoir 10 to the discharge port 12 by successively squeezing and releasing the elastic tube 13. An intermittent drive means, designated generally by the reference numeral 16, is an an operative relationship with a drive source, designated generally by the reference numeral 15, and with the peristaltic pump 14. As is discussed in greater detail below, discharge port 12 can have one of several configurations.

In brief, the method and apparatus of the present invention allows a preselected amount of liquid to be dispensed very accurately in a drop-by-drop fashion.

The method and apparatus of the present invention is now discussed in greater detail. The inventor has discovered that when a liquid is dispensed in a drop-by-drop fashion the weight of each drop is uniform when the liquid is made to flow in a drop-by-drop fashion from a discharge pipe having a discharge face which is perpendicular to the longitudinal axis of the discharge pipe, and having a discharge port with a thin wall. In other words, the weight V of the uniform liquid drop that is dispensed is equal to the product of feed amount Q of the liquid, the interval M in which a liquid drop is produced, and the cycle rate C for producing the drops. The relationship discovered by the inventor allows small drops having a preselected weight and production intervals to be dispensed if the values for the parameters V, Q, M and C satisfy the abovementioned equation.

To express it another way, the present invention allows a preselected amount of liquid from a reservoir 10 to be dispensed in a drop-by-drop fashion when the liquid being intermittently pumped to the discharge port 12 by the successive squeezing and releasing of an elastic tube 13 by the peristaltic pump 14, when the face of the discharge port 12 is perpendicular to the longitudinal axis of the discharge port 12 and the outer diameter of the discharge port is less than or equal to twice the inner diameter of the discharge port, and when the dispensed liquid in drop form satisfys the following conditions:

(1) $V=Q\times M\times C$
(2) 50 mg$\geqq$Q
(3) 0.5 seconds$\leqq$M
(4) 3/seconds$\geqq$C
(5) $1.5\leqq M\times C$ wherein:

V is the weight of the dispensed liquid drop,
Q is the feed quantity of the liquid,
M is the time interval beteeen successive drops, and,
C is the cycle of the pump.

The discharge port 12 is required to be shaped such that its face is perpendicular to the longitudinal axis of the discharge port 12. In addition, the outer diameter of the discharge port 12 must be equal to or less then twice the inner diameter of the discharge port 12. If these requirements are not satisfied, the liquid drop dripping from the discharge port 12 is adversely affected by the wall thickness of the discharge port such that the weight and the quantity of the drops is not uniform.

As stated above, the inventor has discovered that to discharge very accurately an uniform amount of liquid in a drop-by-drop fashion, it is necessary that the weight V of the liquid drop dispensed by the discharge port be equal to the product of feed liquid amount Q, which is less than or equal to 50 mg, the interval M in which the liquid drop is produced, which is more than or equal to 0.5 seconds and the cycle C for forcibly feeding the liquid, which is less than or equal to 3/sec. The interval in which the liquid drop is produced is equal to the quotient obtained by dividing the forced feed frequency n of feed amount Q by forced feed cycle C. Also, the interval M in which the liquid drop is produced is the time required for each liquid drop to be dispensed. If the above mentioned requirements cannot be met, an uniform amount of liquid V cannot be dispensed at a regular interval, even if the requirement for the discharge port is satisfied because the feed amount Q of the liquid is not intermittently pumped to the discharge port under stable conditions.

The above-mentioned V requirement is preferably met by making the feed amount Q less than or equal to 2.8 mg, the interval M more than or equal to 3 seconds, and the pumping cycle less than or equal to 2/sec, and finally, the product $M\times C\geqq 6$.

In the case where $Q\leqq 2.8$ mg, $M\geqq 3.0$ seconds, $C\leqq 2$/seconds, and the product $M\times C\geqq 6$, the invention has determined, as is discussed in detail below, that the standard deviation $\sigma$ of the dispensed drops of preselected weight is less than or equal to 0.6. In other words, if the average $\overline{V}$ for the preselected weight V with respect to the standard deviation $\sigma$ sample is divided by the standard deviation $\sigma$ so as to give the screening factor $(\overline{V}/\sigma)$, the value for the screening factor is more than 100.

Means for intermittently pumping the liquid to the discharge port 12 is preferably a peristaltic pump 14. Such a peristaltic pump can intermittently pump liquids of various properties, can insulate the liquids completely from the peristaltic pump 14 itself, and can minimize the liquid leakage and permit the elastic tube 13 to be easily replaced when it is clogged. The peristaltic pump 14 may be of the type which carries out the squeezing and releasing of an elastic tube 13 by the raising and lowering of at least three pushers, or of the type in which an elastic tube 13 is in squeezing engagement between a circular path and at least two roller-shaped pushers arranged to rotate along the circular path, or of the type in which an elastic tube 13 is pressed by at least two circulating roller-shaped pushers arranged along the elastic tube 13 which is placed on a flat surface.

The discharge port 12 preferably has a shape and is fabricated from a material having a low flow resistance between the wall of the discharge port and the liquid. For example, discharge port 12 is preferable selected from the group comprising, for example, stainless steel, a fluoride containing resin, a polyacetal resin, a silicone resin, polyethylene resin, and polypropylene.

The discharge port 12 preferably is shaped such that the face is perpendicular to the longitudinal axis of discharge port and has the minimum outer and inner peripheries with respect to the sectional area of the face. In addition, the inner and outer peripheries of the face of the discharge port 12 are concentric. It is also preferable that the edge of the discharge port face be cut in such a way so as not to have any burrs or the like, and the discharge port face is preferably polished to a mirror finish. Though the inner diameter of the discharge port 12 may be selected to be any dimension, it is preferable that the inner diameter be in the range of 0.1 to 8 mm. The outer diameter of the discharge port 12 is preferably less than or equal to twice the inner diameter of the discharge port, and it is preferable that the difference between the outer and inner diameters be minimized.

The ratio of the outer diameter to the inner diameter of the discharge port 12 is preferably selected such that the outer diameter is less than or equal to twice the inner diameter if the inner diameter is in the range of 0.1 to 0.49 mm. It is preferable that the outer diameter be less than or equal to 1.5 times the inner diameter when the inner diameter is in the range of 0.5 to 0.99 mm. Furthermore, it is preferable that the outer diameter be less than or equal to 1.4 times the inner diameter when the inner diameter is in the range of 1.0 to 1.99 mm. In addition, it is preferable that the outer diameter be less than or equal to 1.3 times the inner diameter when the outer diameter in the range of 2.0 to 2.99 mm. Finally, it is preferable that the outer diameter be less than or equal to 1.2 times the inner diameter when the inner diameter is in the range of 3.0 to 8.0 mm. There is no limit to the length of the discharge port 12. The length is preferably selected in relation to the viscosity of liquid being dispensed. It should be noted that a length of more than or equal to 50 mm is typically not needed.

As stated above, discharge port 12 can be formed from a thin-walled cylinder of stainless steel. The face of the discharge port 12 is preferable perpendicular to the longitudinal axis of the discharge port 12. Several possible shapes for the nozzle of the discharge port face 12 are shown in FIGS. 2 to 6, respectively.

Figure 7:
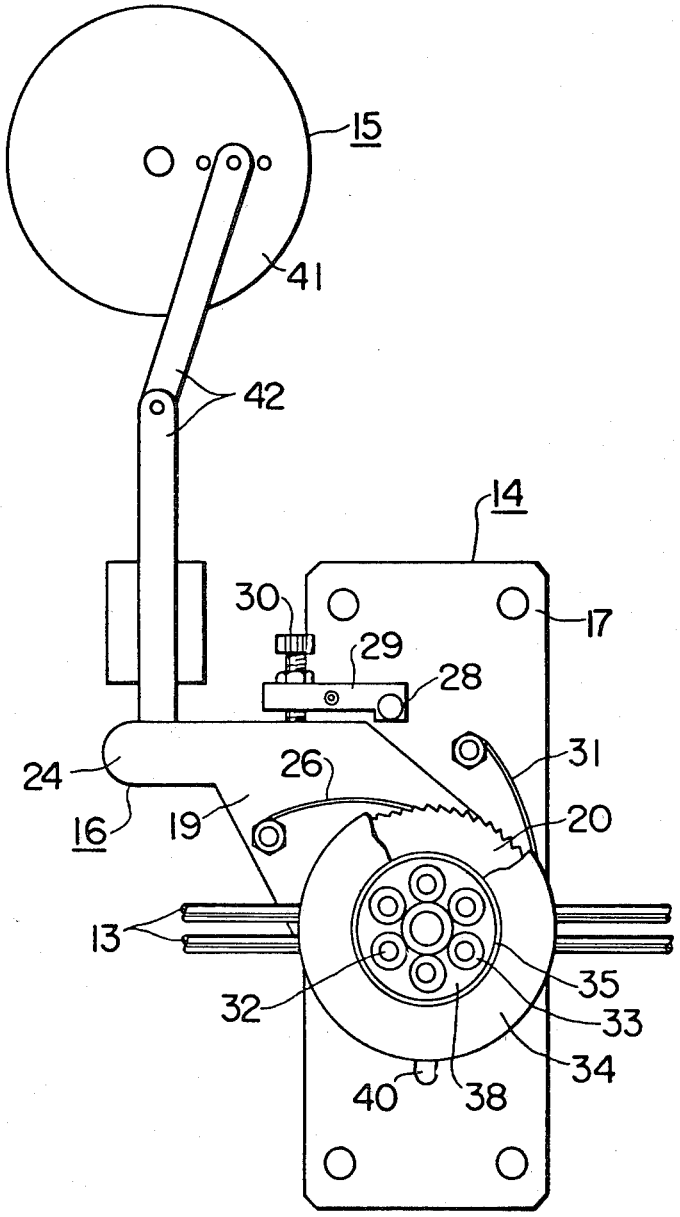
FIG. 7 is a front view of the peristaltic pump provided with an intermittent drive means.
Figure 8:
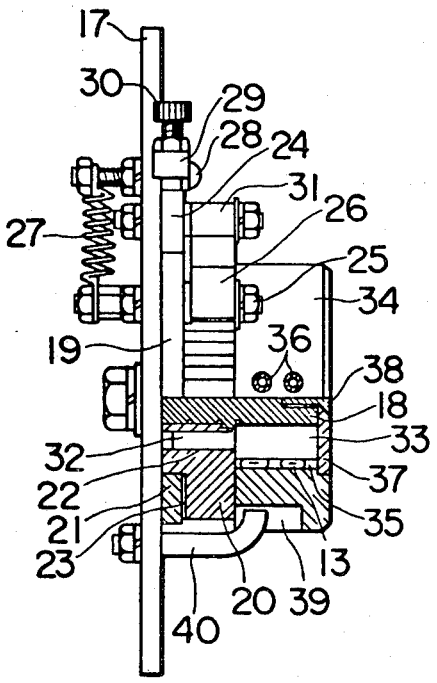
FIG. 8 is a fragmentary sectional view of the peristaltic pump as shown in FIG. 7.

A suitable example of the peristaltic pump 14 and the intermittent drive means 16 is now described in detail with reference to FIGS. 7 and 8. A fixed shaft 18 is mounted on a rectangular plate-shaped mount 17 perpendicular thereto and is extended through to a ratchet wheel 20 having an arm 19 fitted therein to hold rotatably the ratchet wheel 20. The ratchet wheel 20 is provided on the side facing the mount 17 with a circular projection 21 having smaller diameter than the diameter of the ratchet wheel 20. Six holes 22 are provided in a circular arrangement at the opposite side to the side provided with the projection 21 and having the center on the axis of the ratchet wheel 20. An arm 19 is formed integrally with a ring-shaped base 23 and a projection 24 extending therefrom. The inner diameter of the base 23 is made to be approximately equal to the other diameter of the projection 21 so as to loosely fit the projection 21 in the arm 19 and to locate the arm 19 between the mount 17 and the ratchet wheel 20. A screw 25 is also mounted on the arm 19 so as to have ends projecting from both surfaces of the arm 19. One end of screw 25 is provided with a feed claw 26 for engaging with the teeth of the ratchet wheel 20. On the other end of screw 25 is mounted one end of a coil spring 27 fixed to the back of the mount 17 normally to pull the arm 19 clockwise, as viewed in FIG. 7.

The side of the mount 17 facing the arm 19 is provided with a stopper piece 29 fixed by a screw 28. An adjusting screw 30 is screwed into the stopper piece 29 to regulate the clockwise rotation of the arm 19, which is adapted to make contact with the end of the adjusting screw 30. The screw 28, fixing the stopper piece 29, extends through the mount 17 to mount the other end of the coil spring 27 at the projecting end. Also on the side of the mount 17 facing the arm 19 is mounted a detent 31 engaging with the teeth of the ratchet wheel 20 to prevent it from rotating counterclockwise.

Six pins 32 are fitted into the respective holes 22 provided in the ratchet wheel 20. Rollers 33 are rotatably mounted on pins 32 and spaced from each other at a predetermined interval so as not to be in contact with each other.

An annular case 34 is arranged around the rollers 33 such that the clearance between the circumferential surface of the roller 33 and the inner circular surface 35 of the annular case 34 is identical at all portions. Single or plural hole-shaped holders 36 are provided on the circumferential portions of the case 34 and are diametrically opposed. Single or plural elastic tubes 13, each having a diameter larger than that of the hole of the holder 36, are fixedly press-fitted into the holder 36 and they are press-fitted between the rollers 33 and the inner surface 35 of the case 34.

One end of the elastic tube 13 is connected with the liquid source 11 and the other end is connected with the discharge port 12. Further, when a plurality of the elastic tubes 13 are employed, they are connected with the discharge port 12 through a combining means. A transparent cover plate 37 covers the opened surface of the case 34. A screw 38 extends through the cover plate 37 and is screwed into the fixed shaft 18 extending to the cover plate 37 for mounting integrally the ratchet wheel 20 and the case 34 on the mount 17. A stopper 40 fixed to the mount 17 is adapted to engage with a hole 39 provided on the outer periphery of the case 34 to prevent the case 34 from rotating about the fixed shaft 18.

On a rotary drum 41 of the drive source 15 is mounted a linkage 42, which converts the rotational motion of the drum 41 to a linear reciprocating motion. The linkage 42 is located in the projection 24 of the arm 19 to permit the swing thereof.

Next, the various experiments performed in accordance with the method and apparatus of the present invention are described Experiment 1.

The feed claw of the peristaltic pump 13 was set to engage the ratchet wheel having four teeth and two elastic tubes 13 of 1 mm inner diameter were used. The elastic tubes 13 were provided with a combining means which was connected to the discharge port 12. The discharge port 12 had an inner diameter of 1.0 mm and the outer diameter was less than 1.4 times the inner diameter. The rotation of the motor connected with the arm was adjusted by a stepwise change gear so as to reciprocate the linkage and swing the arm about the fixed shaft one time per second. By the swing of the arm the ratchet wheel connected with the arm was rotated intermittently, and the rollers mounted on the pins of the ratchet wheel revolved about the fixed shaft to successively squeeze and release the elastic tube 13 press-fitted into the inner surface of the case. The liquid from the liquid source was, thus, intermittently pumped at a rate of 2.8 mg of liquid amount per each intermittence pressing of the elastic tube 13. A liquid drop having an average weight of 23.71 mg was produced from the discharge port 12 at intervals of 7.4 seconds. It should be noted that tap water was used as the liquid.

Next, the various experiments and the comparisons of experiment results as shown in Tables 1 and 2, respectively, will now be discussed.

TABLE 1

| Experiment No. | Inner diameter of discharge port 12 (mm) | Elastic tube is (number of pieces) | Ratchet (number of teeth) | Feed amount Q (mg) | Frequency C of forced feed per unit time (times/sec) | Interval M in which liquid drop is produced (second) | Average value V of drop weight (mg) | Standard deviation value ($o$) | Screening factor $V/o$ | Forced feed frequency unit drop is formed (times) |
|---|---|---|---|---|---|---|---|---|---|---|
| 1 | 1.0 | 2 | 4 | 2.8 | 1 | 7.4 | 23.71 | 0.50 | | 7.4 |
| 2 | 0.1 | 1 | 1 | 0.3 | 1 | 17 | 4.68 | 0.06 | 78 | 17 |
| 3 | 0.25 | 1 | 1 | 0.3 | 1 | 30 | 10.58 | 0.1 | | 30 |
| 4 | 0.25 | 2 | 1 | 0.7 | 1 | 14 | 10.03 | 0.09 | | 14 |
| 5 | 0.25 | 1 | 2 | 0.7 | 1 | 15 | 10.05 | 0 | | 15 |
| 6 | 0.25 | 1 | 4 | 1.4 | 1 | 7 | 9.77 | 0.36 | | 7 |
| 7 | 0.25 | 1 | 1 | 0.3 | 2 | 15.5 | 10.36 | 0.17 | | 31 |
| 8 | 0.25 | 1 | 2 | 0.7 | 2 | 6.5 | 10.57 | 0.09 | | 13 |
| 9 | 0.25 | 1 | 4 | 1.4 | 2 | 3.5 | 10.66 | 0.13 | | 7 |
| 10 | 0.25 | 2 | 6 | 3.5 | 2 | 1.5 | 10.02 | 0.96 | | 3 |
| 11 | 0.5 | 1 | 1 | 0.3 | 1 | 45 | 14.85 | 0.21 | | 45 |
| 12 | 0.5 | 2 | 1 | 0.7 | 1 | 20 | 15.09 | 0.24 | | 20 |
| 13 | 0.5 | 1 | 2 | 0.7 | 1 | 22 | 15.12 | 0.21 | | 22 |
| 14 | 0.5 | 2 | 2 | 1.4 | 1 | 10 | 14.65 | 0.40 | | 10 |
| 15 | 0.5 | 1 | 4 | 1.6 | 1 | 10 | 13.73 | 0.48 | | 10 |
| 16 | 0.5 | 3 | 2 | 2.0 | 1 | 6 | 13.18 | 0.84 | 16 | 6 |
| 17 | 0.5 | 2 | 3 | 2.4 | 1 | 6 | 14.35 | 0.87 | 16 | 6 |
| 18 | 0.5 | 2 | 4 | 2.8 | 1 | 5 | 14.79 | 0.36 | | 5 |
| 19 | 0.5 | 1 | 1 | 0.3 | 2 | 20 | 13.81 | 0.53 | | 40 |
| 20 | 0.5 | 1 | 2 | 0.7 | 2 | 8 | 12.92 | 0.89 | | 16 |
| 21 | 0.5 | 1 | 4 | 1.4 | 2 | 3 | 8.48 | 0.48 | | 6 |
| 22 | 1.0 | 1 | 1 | 0.3 | 1 | 70 | 24.24 | 0.07 | | 70 |
| 23 | 1.0 | 2 | 1 | 0.7 | 1 | 30 | 23.11 | 0.43 | | 30 |

TABLE 1-continued

| Experiment No. | Inner diameter of discharge port 12 (mm) | Elastic tube is (number of pieces) | Ratchet (number of teeth) | Feed amount Q (mg) | Frequency C of forced feed per unit time (times/sec) | Interval M in which liquid drop is produced (second) | Average value V of drop weight (mg) | Standard deviation value (o) | Screening factor $\bar{V}/o$ | Forced feed frequency unit drop is formed (times) |
|---|---|---|---|---|---|---|---|---|---|---|
| 24 | 1.0 | 2 | 2 | 1.4 | 1 | 15 | 24.09 | 0.50 | | 15 |
| 25 | 1.0 | 1 | 1 | 0.3 | 2 | 36 | 23.70 | 0.44 | | 72 |
| 26 | 1.0 | 1 | 2 | 0.7 | 2 | 15 | 22.45 | 0.83 | | 30 |
| 27 | 1.8 | 2 | 1 | 0.7 | 1 | 53 | 40.33 | 0.55 | | 53 |
| 28 | 1.8 | 2 | 2 | 1.4 | 1 | 28 | 39.45 | 0.27 | | 28 |
| 29 | 1.8 | 2 | 4 | 2.8 | 1 | 15 | 43.05 | 0.23 | | 15 |
| 30 | 2.7 | 2 | 1 | 0.7 | 1 | 67 | 48.59 | 0.38 | | 67 |
| 31 | 2.7 | 1 | 3 | 1.1 | 1 | 43 | 50.8 | 0.42 | | 43 |
| 32 | 2.7 | 2 | 2 | 1.4 | 1 | 35 | 49.86 | 0.56 | | 35 |
| 33 | 2.7 | 2 | 3 | 2.4 | 1 | 26 | 50.8 | 0.704 | 72 | 26 |
| 34 | 2.7 | 2 | 6 | 3.5 | 1 | 14 | 50.95 | 0.62 | | 14 |
| 35 | 2.7 | 4 | 4 | 5.5 | 1 | 10 | 56.77 | 0.17 | | 10 |
| 36 | 2.7 | 2 | 1 | 0.7 | 3 | 22.3 | 49.62 | 0.27 | | 67 |
| 37 | 3.8 | 2 | 1 | 0.7 | 1 | 87 | 62.00 | 0.28 | | 87 |
| 38 | 3.8 | 1 | 3 | 1.1 | 1 | 60 | 67.00 | 0 | | 60 |
| 39 | 3.8 | 2 | 2 | 1.4 | 1 | 44 | 63.80 | 0.81 | 79 | 44 |
| 40 | 3.8 | 4 | 2 | 2.0 | 1 | 30 | 67.84 | 0.13 | | 30 |
| 41 | 3.8 | 2 | 1 | 0.7 | 3 | 29 | 65.59 | 0.37 | | 87 |
| 42 | 3.8 | 2 | 2 | 1.4 | 3 | 15 | 63.61 | 0.41 | | 45 |
| 43 | 3.8 | 2 | 4 | 2.8 | 3 | 7 | 64.98 | 1.37 | | 21 |
| 44 | 4.8 | 1 | 2 | 0.7 | 1 | 98 | 73.3 | 0.68 | 108 | 98 |
| 45 | 4.8 | 1 | 3 | 1.1 | 1 | 64 | 72.4 | 0.70 | 103 | 64 |
| 46 | 4.8 | 2 | 2 | 1.4 | 1 | 54 | 73.2 | 0.68 | 108 | 54 |
| 47 | 4.8 | 2 | 4 | 2.8 | 1 | 28 | 74.98 | 0.18 | | 28 |
| 48 | 7.1 | 1 | 2 | 0.7 | 1 | 129 | 101.2 | 0.62 | 163 | 129 |
| 49 | 7.1 | 1 | 3 | 1.1 | 1 | 87 | 102.6 | 0.70 | 147 | 87 |
| 50 | 7.1 | 2 | 2 | 1.4 | 1 | 75 | 102.7 | 0.82 | 125 | 75 |
| 51 | 7.1 | 3 | 2 | 2.0 | 1 | 50 | 10.25 | 0.70 | 146 | 50 |

TABLE 2

| Comparison No. | Inner diameter of discharge port 12 (mm) | Elastic tube 13 (number of teeth) | Ratchet (number of teeth) | Feed amount Q (mg) | Frequency C of forced feed per unit time (times/sec) | Interval M in which liquid drop is produced (second) | Average value V of drop weight (mg) | Standard deviation value (o) | Screwing factor $\bar{V}/o$ | Forced feed frequency unit drop is formed (times) |
|---|---|---|---|---|---|---|---|---|---|---|
| 1 | 1.0 | 2 | 4 | 2.8 | 1 | 11 | 31.77 | 4.460 | | 11 |
| 2 | 1.0 | 2 | — | 40cc/hr | — | 2.3 | 25.16 | 2.68 | | — |
| 3 | 7.1 | 2 | 41 | 25 | 4 | 0.61 | 48.7 | 6.558 | 7.42 | 2 |

The materials and liquid for the peristaltic pump 14 and the elastic tube 13 used for experiments 2 to 51 are all the same as those used in experiment 1.

The comparison 1 was performed using the same conditions as were present in experiment 1, except that comparison 1 employed a discharge port 12 having the discharge port face disposed at a 45° angle with the longitudinal axis.

Comparison 2 was performed under the same condition as experiment 1, except that the liquid was continuously pumped fed by the peristaltic pump 13 without use of the intermittent drive 16.

Figure 9:
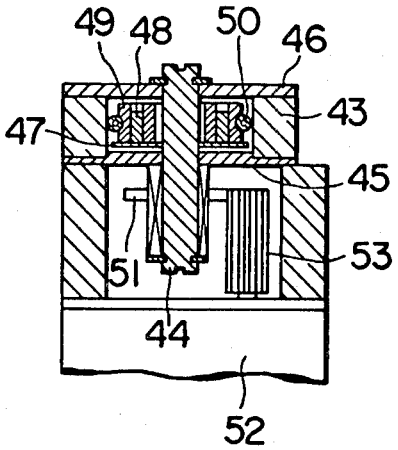
FIG. 9 is a sectional view of the peristaltic pump used in comparison 2; and, FIG. 10 is a graph with the number of drops on the vertical axis versus the weight of the drops on the horizontal axis and plots as curves a, b, c and d the distribution of the weights V of the drops as determined by experiment 1 and by comparisons 1, 2 and 3, respectively.

It should be noted that the peristaltic pump 14 used for comparison 2 is that shown in FIG. 9. Specifically, the open face of the annular case 43 was covered by a bottom plate 45 and a transparent cover plate 46 which had a hole used for the bearing of the drive shaft 44. A disk 47 was mounted on the drive shaft 44 journaled by the cover plate 46, and was also mounted to the bottom plate 45 to rotate with the drive shaft 44. Six pins 48 spaced at equal intervals in the concentric circle of the drive shaft 44 were provided. Six rollers 49 were rotatally mounted on the respective pins 48 at the predetermined intervals so as not to make contact with each other and were arranged to revolve about the drive shaft 44 as the disk 47 was rotated. Two slot holders were provided on the surface of the case at the diametrically opposed portions. Two elastic tubes 50 with the diameter larger than the slot width of the holder were fixedly press-fitted in the respective holders, and were also press-fitted between the rollers 49 and the inside wall of the case 43. A gear 51 was fixedly secured to the lower end of the drive shaft 44 and was adapted to engage a gear 53 mounted on the motor shaft of a motor 52, which rotated at a low speed. The peristaltic pump 44 was driven so as to produce a flow of 40 cc/hour.

Comparison 3 was performed under the same conditions as experiment 1 except that the inner diameter of nozzle, the number of ratchet teeth, the feed amount, the frequency of forced feed per unit time, and the interval in which liquid drop is produced, were different.

With respect to Tables 1 and 2, the following explains how the measured values in these tables were obtained. The measurement of feed amount Q was performed in the following fashion. A vinyl bag provided with a chuck and containing filter paper was prepared and fashioned for fluid flow to the end of the elastic tube 13. 100 times that of the forced feed value were performed for each experiment. The amount of feed liquid was absorbed by the filter paper, and was then weighed using direct-reading scientific balance made by the Shimazu Mfg. Co. of Japan. Thereafter, the weight value was obtained by first subtracting the weight of the vinyl bag and dry filter paper from the total weight, and then dividing this amount by 100 so as to obtain the feed amount Q value.

The average value V of liquid weight was determined in the following manner. The peristaltic pump 14 was activated so as to receive using a cover glass the liquid drop produced at the discharge port. The dry cover glass and the cover glass having the liquid drop were each weighed using the balance discussed above. The weight of the liquid drop was obtained by subtracting the weight of the dry cover glass from the weight of the cover glass having the liquid drop. This measurement was performed 10 times, and the average value of the value of the weight of the drop.

Standard deviation value $\hat{\sigma}$ was calculated using well known statistical methods.

The screening factor $\overline{V}/\hat{\sigma}$ was calculated using standard mathematical procedures. It should be noted that a value of the screening factor greater than 100 was considered to show that a drop of preselected weight could be provided at a high accuracy.

Figure 10:
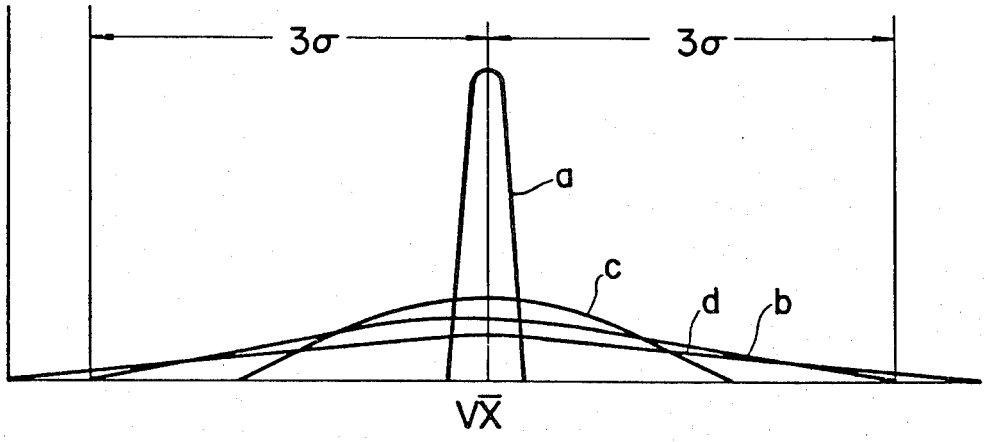

FIG. 10 plots the curves representing the distribution of the weight V of the drops as determined by experiment 1 and by comparison 1, 2, and 3. The number of drops are plotted on the vertical axis versus the weight of the drops on the horizontal axis. Curve a plots the distribution of the weights V of the drops as determined by experiment 1. Curve b plots the distribution of the weights V of the drops as determined by comparison 1. Curve c plots the distribution of the weights V of the drops as determined by comparison 2. Finally, curve d plots the distribution of the weights V of the drops as determined by comparison 3.

As is apparent from curve a, experiment 1 has a mean value ($\overline{V}\overline{X}$) of 23.71 mg and a standard deviation $\hat{\sigma}$ value of 0.50. It should be well noted that the dispersion range, i.e., 22.21 mg to 25.21 mg is very narrow in experiment 1, even if the experiment is carried out with a standard deviation value of 3.

In contrast, as is apparent from curve b, comparison 1 has a mean value ($\overline{V}\ \overline{X}$) of 31.77 mg and a standard deviation value of 4.460. It should be noted that the dispersion range, i.e., 18.6 mg to 44.9 mg, is very large in comparison 1. It will be understood that this large dispersion range was caused by the shape of the discharge port face of the discharge pipe.

As is apparent from curve c, comparison 2 has a mean value ($\overline{V}\ \overline{X}$) of 25.16 mg and a standard deviation value $\hat{\sigma}$ of 2.68. It should be noted that the dispersion range, i.e., 17.11 mg to 33.2 mg is very large in comparison 2. This large dispersion range is caused by the fact that the liquid was not intermittently pumped to the discharge port 12. Because no intermittent drive means was used in making the tests in comparison 2, the value for the variable C was more than 3/sec, and thus the conditions of the present invention given above were not met.

As is apparent from curve d, comparison 3 has a mean value ($\overline{V}\ \overline{X}$) of 48.7 mg and a standard deviation value $\hat{\sigma}$ of 6.558. It should be noted that the dispersion range, i.e., 29.026 mg to 68.374 mg, is very large in comparison 3. This large dispersion range is caused by the fact that the value for the variable C was more than 4/sec, and thus the conditions of the present invention given above were not met.

It should be noted that the interval in which the liquid drop was produced was unstable in comparisons 1, 2, and 3. Specifically, the time interval to produce the liquid drop was in the range of 7.5 seconds to 15 seconds in comparison 1, was in the range of 1.9 seconds to 3 seconds in comparison 2, and was in the range of 0.54 seconds to 0.697 seconds in comparison 3.

As is now apparent from the description given above, the present invention is a method and apparatus for very accurately dispensing a preselected amount of liquid in a drop-by-drop fashion.

What is claimed is:

1. Apparatus for dispensing a preselected amount of a liquid drop-by-drop comprising; a reservoir, a peristaltic pump, an elastic tube coupling said reservoir to a discharge pipe, said liquid being pumped intermittently to said discharge pipe by the successive peristaltically squeezing and releasing of said elastic tube carrying said liquid and connected to said discharge pipe, said discharge pipe having a discharge port with a face, said face being perpendicular to the longitudinal axis of said discharge pipe, the outer diameter of said discharge pipe at said discharge port being than or equal to twice the inner diameter of said discharge pipe at said discharge port, means to regulate said pump whereby said preselected amount of said liquid is dispensed in a drop-by-drop fashion from said discharge port satisfying the following conditions:

(1) $V=Q\times M\times C$
(2) 50 mg $\geqq Q$
(3) 0.5 seconds $\leqq M$
(4) 3/seconds $\geqq C$
(5) $1.5\leqq M\times C$ wherein:

V is the weight of the produced liquid drop,
Q is the amount of liquid pumped per each pump,
M is the time interval between successive drops, and
C is the cycle of the pump.

2. The apparatus as recited in claim 1, wherein 2.8 mg $\geqq Q$, 3.0 seconds $\leqq M$, 2/seconds $\geqq C$, and $6\leqq M\times C$.

3. The apparatus as recited in claim 2, wherein said discharge pipe is a pipe of member selected from the group consisting of stainless steel, a fluorine containing resin, a polyacetal, a silicone resin, polyethylene, and polypropylene.

4. The apparatus as recited in claim 2, wherein said inner diameter of said discharge pipe at said discharge port is in the range of 0.1 to 8 mm.

5. The apparatus as recited in claim 1, wherein said peristaltic pump is of the type having said elastic tube disposed between a circular wall and a plurality of roller-shaped pushers, said roller-shaped pushers being arranged to move along said circular wall in squeezing engagement with said elastic tube.

6. The apparatus as recited in claim 5, wherein said discharge pipe is a pipe of a member selected from the group consisting of stainless steel, a fluorine containing resin, a polyacetal, a silicone resin, polyethylene, and polypropylene.

7. The apparatus as recited in claim 5, wherein said inner diameter of said discharge pipe at said discharge port is in the range of 0.1 to 8 mm.

8. The apparatus as recited in claim 1, wherein said discharge pipe is a pipe of a member selected from the group consisting of stainless steel, a fluorine containing resin, a polyacetal, a silicone resin, polyethylene, and polypropylene.

9. The apparatus as recited in claim 8, wherein said inner diameter of said discharge pipe at said discharge port is in the range of 0.1 to 8 mm.

10. The apparatus as recited in claim 1, wherein said inner diameter of said discharge pipe at said discharge port is in the range of 0.1 to 8 mm.

11. The apparatus of claim 1, wherein said means to regulate said pump comprises intermittent drive means coupled to said pump and a drive source coupled to said intermittent drive means.

12. The apparatus of claim 11, wherein said intermittent drive means comprises means to convert rotary motion of said drive source into a linear reciprocating motion, means coupled to said means to convert to said reciprocating motion into intermittent rotational motion in one direction and, means to transmit said intermittent rotational motion to roller-shaped pushers.

* * * * *